United States Patent [19]

Selby

[11] Patent Number: 4,732,109

[45] Date of Patent: Mar. 22, 1988

[54] MOBILE SEALANT APPLICATOR FOR ROAD JOINTS AND CRACKS

[75] Inventor: Russell D. Selby, Houston, Ohio

[73] Assignee: Schess Equipment Co., Inc., Piqua, Ohio

[21] Appl. No.: 31,423

[22] Filed: Mar. 30, 1987

[51] Int. Cl.[4] ..... B05C 11/04; B05C 5/02

[52] U.S. Cl. ..... 118/713; 118/108; 118/305; 404/111

[58] Field of Search ..... 118/713, 108, 305; 404/107, 108, 111; 222/146.2

[56] References Cited

U.S. PATENT DOCUMENTS

| | | | |
|---|---|---|---|
| 2,578,080 | 12/1951 | Middlestadt | 404/107 |
| 3,227,055 | 1/1966 | Glade | 404/107 |
| 3,841,779 | 10/1974 | Ray | 404/111 |
| 3,873,227 | 3/1975 | Goethe et al. | 404/107 |
| 4,653,424 | 3/1987 | Schloss et al. | 118/108 |

*Primary Examiner*—John P. McIntosh

*Attorney, Agent, or Firm*—Jacox & Meckstroth

[57] ABSTRACT

An asphalt sealant material is heated within an insulated box-like container supported by a front caster wheel and a pair of thin disk-like steel side wheels. A push-type handle bar projects rearwardly and upwardly from the container which has an inner bottom wall sloping downwardly to a side discharge tube. A burner tube extends through a surrounding heater tube located within the lower portion of the container, and a heat exchange oil is confined within the annular space defined between the tubes. A propane fuel tank is supported by a platform projecting rearwardly from the container and is connected by a flexible hose to a nozzle located at the front of the burner tube. The rear of the burner tube connects with a vertical exhaust pipe, and the rear of the heater tube connects with an oil fill tube. The sealant discharge tube receives a valve tube rotatable by a control rod extending from the handle bar, and another control rod raises and lowers a squeegee member supported for vertical movement behind a bottom outlet within the discharge tube.

16 Claims, 4 Drawing Figures

MOBILE SEALANT APPLICATOR FOR ROAD JOINTS AND CRACKS

BACKGROUND OF THE INVENTION

In the art of filling or sealing cracks and joints within a concrete or asphalt roadway surface, it is common to use a hand carried funnel-like container or bucket-like container with a spout for manually dispensing a heated asphalt sealant material. There has also been constructed a mobile applicator which includes a frame supported by a pair of rubber tires and which carries a cylindrical bucket or container for receiving the asphalt sealant material. The container has a side discharge port and is heated by a burner connected to a propane fuel tank also carried by the frame.

SUMMARY OF THE INVENTION

The present invention is directed to an improved mobile asphalt sealant applicator which is convenient to use and provides for heating a supply or batch of asphalt filler or sealant material. The apparatus of the invention also provides for precisely controlling the dispensing or discharge of the heated sealant material and for uniformly heating the material to avoid burnout of any rubber component within the material. In addition, the apparatus of the invention provides for rapidly and efficiently applying the heated sealant material either flush with road surface or in a strip with a rounded bead surface.

In accordance with a preferred embodiment of the invention, a box-like container has inner and outer sheet steel walls forming a sealant receiving chamber closed by a pivotal top cover. An insulation material is confined between the inner and outer walls, and the inner bottom wall slopes downwardly to a side discharge tube. The container is supported by a pair of steel disk-like side wheels and a front caster wheel, and a handle bar projects rearwardly and upwardly from the container.

A propane tank is supported by a platform at the rear of the container and supplies fuel to a nozzle located at the front of the container for directing a flame through a burner tube extending rearwardly through a surrounding heater tube within the lower portion of the chamber. Oil is confined within the annular space between the burner tube and the heater tube and provides for uniform heating of tha asphalt sealant material within the chamber. A rotary valve tube controls the flow of sealant from a bottom outlet within the discharge tube and in front of a pivotally supported squeegee member. Finger tip control rods operate the valve tube and position of the squeegee member for conveniently controlling the application of the hot asphalt sealant material as the apparatus is pushed along a road surface.

Other features and advantages of the invention will be apparent from the following description, the accompanying drawing and the appended claims.

DESCRIPTION OF THE PREFERRED EMBODIMENT

Figure 1:
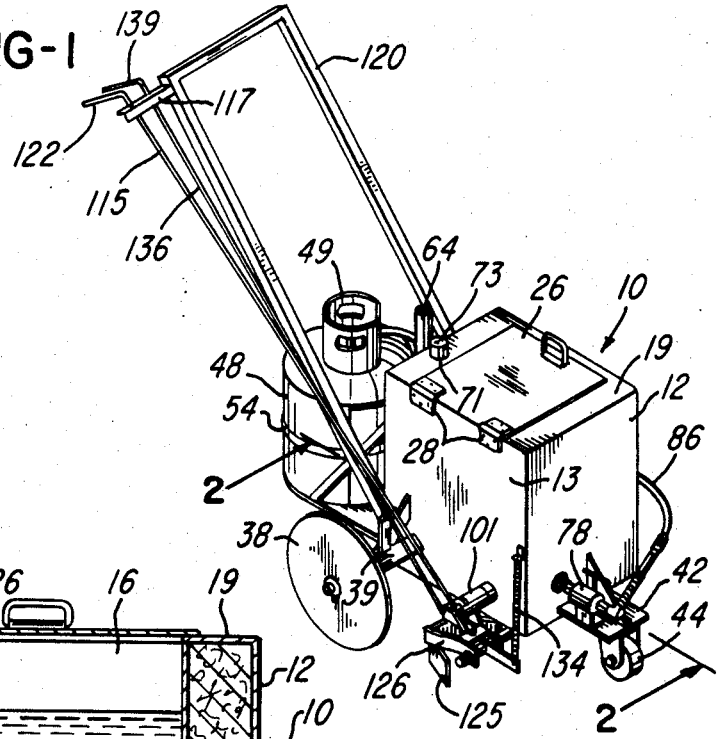
FIG. 1 is a prospective view of a mobile sealant applicator constructed in accordance with the invention.
Figure 3:
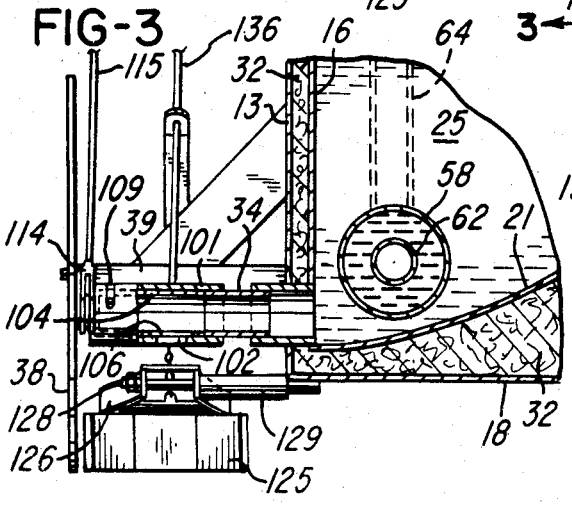
FIG. 3 is a fragmentary section taken generally on the line 3—3 of FIG. 2.

The applicator apparatus illustrated in FIG. 1 includes a box-like insulated container 10 having outer end walls 12 and side walls 13 surrounding corresponding inner walls 14 and 16. The outer walls 12 and 13 are connected by a bottom wall 18 and a top frame-like wall 19, and the inner walls 14 and 16 are connected by a sloping inner bottom wall 21 (FIG. 3). All of the walls are formed from 16 gage steel sheet welded together to form an insulated inner rectangular chamber 25 having a top opening normally covered by a door 26 connected by a pair of hinges 28. The space or cavity defined between the inner and outer walls is filled with a fiber glass insulation material 32, and a discharge pipe or tube 34 projects laterally from the bottom of the chamber 25, as shown in FIG. 3.

The insulated container 10 is supported by a pair of steel disk-like side wheels 38 mounted on axles supported by brackets 39 attached to the outer side walls 13 of the container. A bracket 42 (FIG. 2) projects from the front of the container 10 and carries a front caster or swivel wheel 44. A platform 46 projects rearwardly from the bottom wall 18 of the container 10 to support a propane fuel tank 48 having a top regulator valve (not shown) enclosed within a protector sleve 49. A curved vertical wall 52 is secured to the platform 46, and a removable band or strap 54 secures the propane tank 48 to the wall 52.

Figure 2:
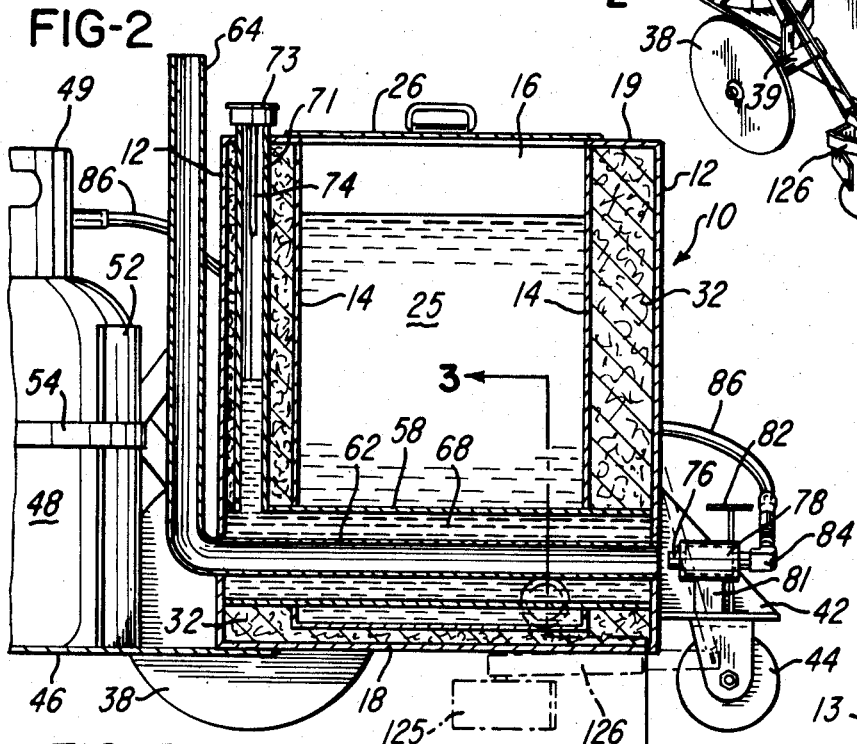
FIG. 2 is a section of the applicator as taken generally on the line 2—2 of FIG. 1.

As shown in FIGS. 2 and 3, a steel heater tube 58 extends between the front and rear outer walls 12 of the container 10 and surrounds a concentric burner tube 62. The burner tube extends rearwardly from the front outer wall 12 through the rear outer wall 12 and then upwardly to form an exhaust pipe or tube 64. A sealed annular space 68 is defined between the heater tube 58 and the inner burner tube 62 and is filled with a heat exchange liquid or oil supplied through a fill tube 71 projecting upwardly between the rear walls 12 and 14 and through the top wall 19 of the container 10. A temperature indicating thermometer 73 is carried by the upper end of the oil fill tube 71 and has a probe 74 projecting down into the tube 71 and into the oil within the tube 71 to indicate the temperature of the oil within the chamber 68.

A nozzle tube 76 is supported in alignment with the forward end of the burner tube 62 by a surrounding support tube 78. The tube 78 provides a wind shield to air supply holes (not shown) within the nozzle tube 76 and is supported by a bracket 81 removably mounted on the bracket 42 by a bolt with a "T" handle 82. The forward end of the nozzle tube 76 is connected by a fitting 84 and a flexible hose 86 to the regulator valve on the propane tank 48.

Figure 4:
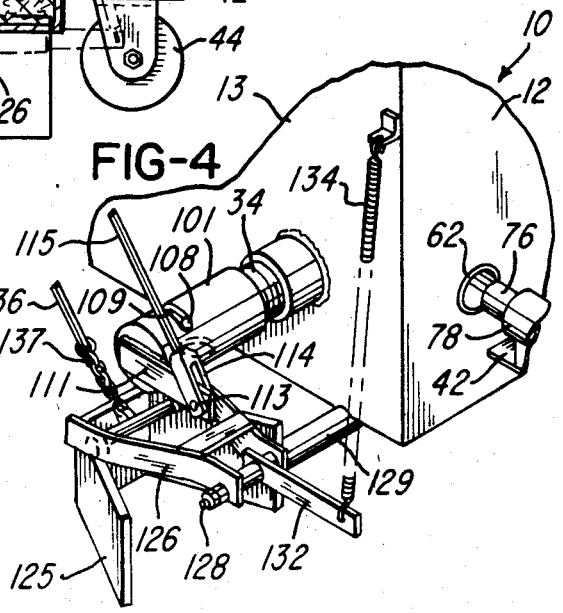
FIG. 4 is an enlarged fragmentary prospective view showing the discharge control valve and applicator squeegee member.

Referring to FIGS. 3 and 4, the sealant discharge tube 34 supports a stationary discharge sleeve 101 having a bottom circular outlet 102. A valve member or tube 104 is supported for rotation within the sleeve 101 and also has a circular discharge opening or outlet 106. When the valve tube 104 is rotated to an open position where the outlet 106 aligns with the outlet 102, the heated asphalt sealant flows through the outlet tube 34 and is discharged or dispensed onto the road surface. The angle of rotation of the valve tube 104 is limited by movement of a screw 108 threaded into the valve tube and confined within an arcuate slot 109 within the surrounding discharge sleeve 101.

A lever 111 (FIG. 4) is secured to the outer closed end of the valve tube 104 and is connected by a pivot pin 113 to a yoke fitting 114 secured to the forward end of a control member or rod 115. The upper end portion of the control rod 115 is supported by a bracket 117 projecting laterally from a U-shaped handle bar member 120 secured to the outer side walls 13 of the container 10. The control rod 115 has an angular tip portion 122 (FIG. 1) which is gripped by the operator to move the rod 115 axially for rotating the valve tube 104 to open and close the discharge outlet 102.

As also shown in FIGS. 3 and 4, a rigid metal squeegee member 125 is rigidly secured to an arm 126 pivotably supported by a shaft 128 projecting axially from a cylindrical stud 129 secured to the outer bottom wall 18 of the container 10. A lever 132 is secured to the arm 126 and receives a tension spring 134 connected to the container 10 for normally biasing or urging the squeegee member 125 downwardly into sliding contact with the road surface. Another control member or rod 136 has a lower end connected to the squeegee member 125 by flexible chain 137. The upper end of the control rod 136 has an angular tip portion 139 for moving the rod 136 axially to raise the squeegee member 125 against the bias of the spring 134 when it is desired to elevate the squeegee member to a retracted and ineffective position.

From the drawing and the above position, it is apparent that mobile applicator apparatus constructed in accordance with the present invention, provides desirable features and advantages. For example, the location of the heater tube 58 within the lower portion of the insulated container chamber 25 and the use of the heat exchange liquid or oil within the chamber 68 surrounding the burner tube 62, provide for efficiently heating the asphalt sealant material within the chamber 25 and for obtaining a uniform temperature of the material. By observing the thermometer 74, the regulator controlling the flow of propane fuel to the nozzle 76 may be precisely adjusted to select the optimum temperature for the sealant material.

The sealant discharge valve and its operation with rod 115 from the handle 120 also permits the operator to control precisely the discharge flow rate of the heated sealant through the outlet 102 while the operator is viewing the flow and pushing the mobile applicator along a path where the outlet 102 is located directly above a crack or joint within the road surface. With the use of the control rod 136, the operator may also conveniently select when to use the squeegee member 125 so that the sealant material may be applied flush with the road surface or, when the squeegee member is elevated, in the form of a bead of sealant material over the crack or joint. In addition, the steel disk wheels 38 minimize the build-up of material on the wheels, and if any small amount of material does accumulate on the outer peripheral edge surfaces of the wheels, the material may be burned off with the flame discharged from the nozzle tube 76 after the nozzle tube is removed from its support tube 78.

While the form of applicator apparatus herein described constitutes a preferred embodiment of the invention, it is to be understood that the invention is not limited to this precise form of apparatus and that changes may be made therein without departing from the scope and spirit of the invention as defined in the appended claims.

The invention having thus been described, the following is claimed:

1. Mobile applicator apparatus for applying a fluid sealant to cracks and joints in a road surface, comprising a container for receiving a supply of the sealant, a set of wheels supporting said container for movement along the surface, a push-type handle member projecting rearwardly fromm said container, an elongated burner tube extending through a portion of said container, a heater tube surrounding said burner tube, means for connecting said burner and heater tubes to define a chamber therebetween, means for supplying a heat exchange liquid to said chamber, a fuel burner nozzle for directing a flame axially into said burner tube to heat the heat exchange liquid and the fluid sealant within said container, a discharge tube extending laterally from a lower portion of said container and having an outlet for discharging the heated sealant from said container, a valve member mounted on said discharge tube and movable between open and closed positions adjacent said outlet, control means extending from said handle member for manually moving said valve member to control the flow of heated sealant from said outlet, means mounted on said container for supporting a propane fuel tank, a line connecting said propane fuel tank to said nozzle, and a squeegee member disposed rearwardly of said outlet adjacent the road surface for spreading the sealant discharged from said outlet onto the surface when said valve member is in said open position.

2. Apparatus as defined in claim 1 wherein said container comprises inner walls disposed within outer walls and spaced to define a cavity therebetween, a heat insulation material disposed within said cavity, and said heater tube is disposed within said container inwardly of said inner walls for receiving the fluid sealant completely around said heateer tube.

3. Apparatus as defined in claim 1 wherein said container has an inclined bottom wall sloping downwardly in a lateral direction toward said discharge tube, and said heater tube is disposed adjacent a lower portion of said inclined bottom wall.

4. Apparatus as defined in claim 1 wherein said set of wheels comprise a pair of metal disk-like side wheels each having a thin outer peripherial surface.

5. Apparatus as defined in claim 4 wherein said set of wheels comprise a front swivel-type caster wheel disposed fowardly of said side wheels, and said handle member is inclined upwardly in a rearward direction from said container.

6. Apparatus as defined in claim 1 wherein said valve member comprises a valve tube supported by said discharge tube for rotation, and said control means include a control rod extending generally parallel to said handle member for rotating said valve tube.

7. Apparatus as defined in claim 1 and including an arm member pivotly connected to said container and supporting said squeegee member for generally vertical movement between a lower position engaging the road surface and a retracted elevated position spaced above the road surface.

8. Apparatus as defined in claim 7 and further comprising a control member extending from said handle member, and means connecting said control member to said squeegee member for moving said squeegee member between said lower and elevated positions in response to manual movement of said control member.

9. Apparatus as defined in claim 1 wherein said burner tube extends completely through said container in a direction generally perpendicular to the axis of said wheels, said burner tube having a forward end portion and a rearward end portion, said nozzle is positioned adjacent said forward end portion, and an exhaust tube is connected to said rearward end portion of said burner tube.

10. Mobile applicator apparatus for applying a fluid sealant to cracks and joints in a road surface, comprising a container for receiving a supply of the sealant, a set of wheels supporting said container for movement along the surface and including a pair of disk-like sheet metal side wheels, a push-type handle member projecting rearwardly from said container, an elongated burner tube extending through a portion of said container, a heater tube surrounding said burner tube, means for connecting said burner and heater tubes to define a chamber therebetween, means for supplying a heat exchange liquid to said chamber, a fuel burner nozzle for directing a flame axially into said burner tube to heat the heat exchange liquid and the fluid sealant within said container, a discharge tube extending laterally from a lower portion of said container and having an outlet for discharging the heated sealant from said container, a tubular valve member mounted on said discharge tube for rotation between open and closed positions adjacent said outlet, control means extending from said handle member for manually rotating said valve member to control the flow of heated sealant from said outlet, means mounted on said container for supporting a propane fuel tank, a line connecting said propane fuel tank to said nozzle, and a squeegee member disposed rearwardly of said outlet adjacent the road surface for spreading the sealant discharged from said outlet onto the surface when said valve member is in said open position.

11. Apparatus as defined in claim 10 wherein said container comprises box-like inner walls spaced within box-like outer walls to define a cavity surrounding said inner walls, a heat insulation material disposed within said cavity, and said heater tube is disposed within said container inwardly of said inner walls for receiving the fluid sealant completely around said heater tube.

12. Apparatus as defined in claim 11 wherein said container has an inclined inner bottom wall sloping downwardly in a lateral direction toward said discharge tube, and said heater tube is spaced above a lower portion of said bottom wall.

13. Apparatus as defined in claim 10 and including an arm member pivotly connected to said container and supporting said squeegee member for pivotal movement between a lower position engaging the road surface and a retracted elevated position spaced above the road surface.

14. Apparatus as defined in claim 13 and further comprising a control rod extending from said handle member, and means connecting said control rod to said squeegee member for moving said squeegee member between said lower and elevated positions in response to manual movement of said control rod.

15. Apparatus as defined in claim 10 wherein said burner tube extends completely through said container in a direction generally perpendicular to the axis of said wheels, said burner tube having a forward end portion and rearward end portion, said nozzle is positioned adjacent said forward end portion, and an exhaust tube is connected to said rearward end portion of said burner tube.

16. Apparatus as defined in claim 10 and including a thermometer disposed for measuring the temperature of the heat exchange liquid.

* * * * *